US008435080B2

(12) United States Patent
Dobler et al.

(10) Patent No.: US 8,435,080 B2
(45) Date of Patent: May 7, 2013

(54) JACK SOCKET FOR PRODUCING AN ELECTRICAL PLUG CONNECTION

(75) Inventors: Oliver Dobler, Tschagguns (AT); Werner Bachmann, Schaan (LI)

(73) Assignee: Neutrik AG, Schaan (LI)

( * ) Notice: Subject to any disclaimer, the term of this patent is extended or adjusted under 35 U.S.C. 154(b) by 0 days.

(21) Appl. No.: 13/363,636

(22) Filed: Feb. 1, 2012

(65) Prior Publication Data

US 2012/0196487 A1 Aug. 2, 2012

(30) Foreign Application Priority Data

Feb. 2, 2011 (DE) ..... 10 2011 010 155

(51) Int. Cl.
*H01R 24/58* (2011.01)

(52) U.S. Cl.
USPC ..... 439/668

(58) Field of Classification Search ..... 439/668, 439/709, 712, 814, 798, 797
See application file for complete search history.

(56) References Cited

U.S. PATENT DOCUMENTS

| | | | | |
|---|---|---|---|---|
| 3,133,779 | A * | 5/1964 | Stanback | 439/798 |
| 4,165,147 | A | 8/1979 | Buck | |
| 4,214,806 | A * | 7/1980 | Kraft | 439/620.21 |
| 4,392,708 | A | 7/1983 | Bailey et al. | |
| 4,603,376 | A * | 7/1986 | Maier | 361/824 |
| 4,695,116 | A | 9/1987 | Bailey et al. | |
| 5,032,092 | A * | 7/1991 | Linn | 439/723 |
| 6,319,030 | B1 | 11/2001 | Wu | |
| 6,579,131 | B1 * | 6/2003 | Ashcraft et al. | 439/798 |
| 6,690,801 | B2 | 2/2004 | Yeh | |
| 7,198,504 | B2 | 4/2007 | Chien et al. | |
| 7,341,491 | B2 | 3/2008 | Zhu et al. | |
| 2006/0281362 | A1 | 12/2006 | Huang | |
| 2007/0117433 | A1 | 5/2007 | Pavlovic | |

FOREIGN PATENT DOCUMENTS

EP 0616393 A2 9/1994

OTHER PUBLICATIONS

American National Standard: EIA Standard RS-453: Dimensional, Mechanical, and Electrical Characteristics Defining Phone Plugs and Jacks, Engineering Department, Electronic Industries Association, 2001 Eye Street, N.W., Washington, DC 20006, May 1978.

NORME Internationale, International Standard, CEI IEC 603-11, Premiere Edition, First Edition, Mar. 1992, pp. 3, 7, 9, 11, 13, 15, 23, 25, 27, and 31.

Search Report, DE, Feb. 2, 2011, Oliver Dobler et al.

* cited by examiner

*Primary Examiner* — Tulsidas C Patel
*Assistant Examiner* — Phuongchi Nguyen
(74) *Attorney, Agent, or Firm* — Harris Beach PLLC; Neal L. Slifkin

(57) ABSTRACT

A jack socket to produce a electrical plug connection with a jack plug includes housing (10) with a space, in which the plug shaft can be inserted; a sleeve contact (20) to contact the contact sleeve of the jack plug; a tip contact (30) with a contact section (32) which, in the inserted state of the jack plug, can be contacted from the contact tip and a tip switching contact (40) with a contact section (42), which, without the inserted jack plug, lies against a tip switching contact contact point of the contact section (32) of the tip contact (30) and is lifted off the contact section of the tip contact (30) during the insertion of the jack plug. The connecting sections (21, 31, 41 51, 61) of the contacts (20, 30, 40, 50, 60) project from an attachment end (14) of the plug housing (10) and have a longitudinal extension.

17 Claims, 5 Drawing Sheets

Figure 1:
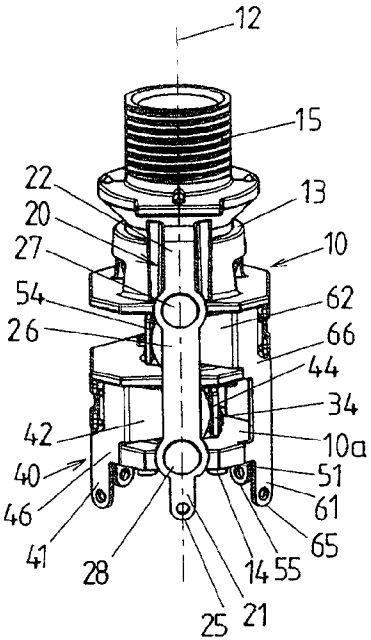
Figure 2:
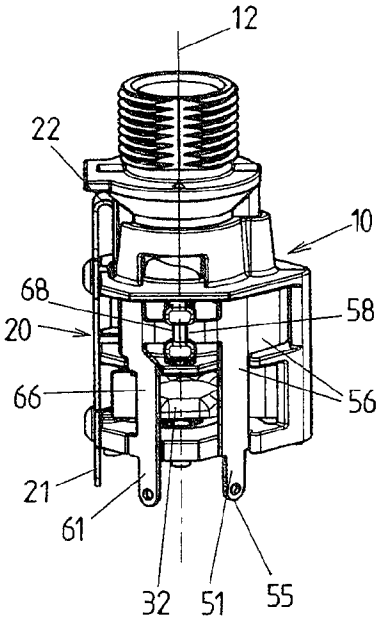
Figure 3:
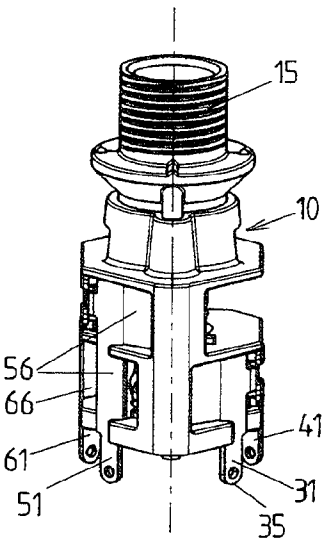
Figure 4:
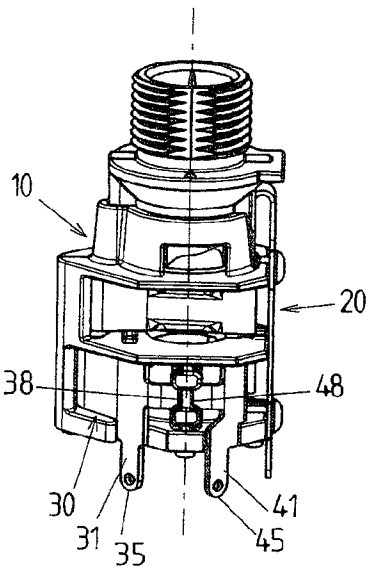

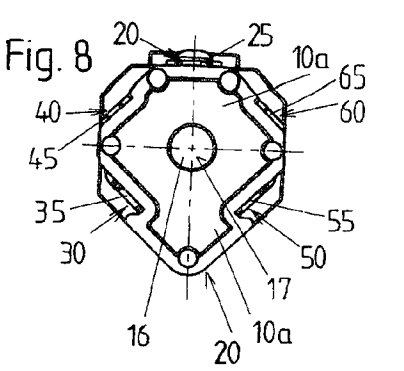
Fig. 8
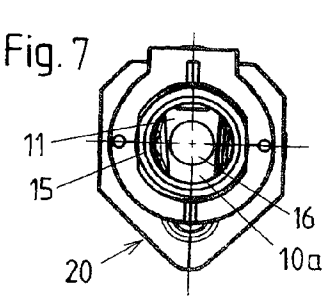
Fig. 7
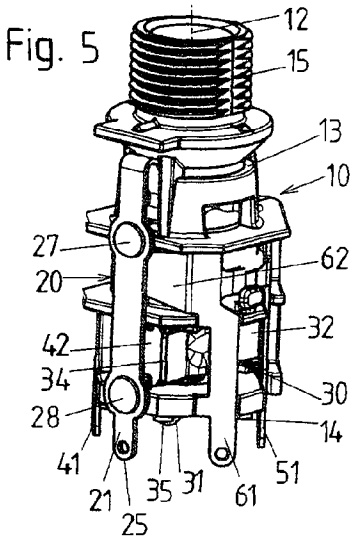
Fig. 5
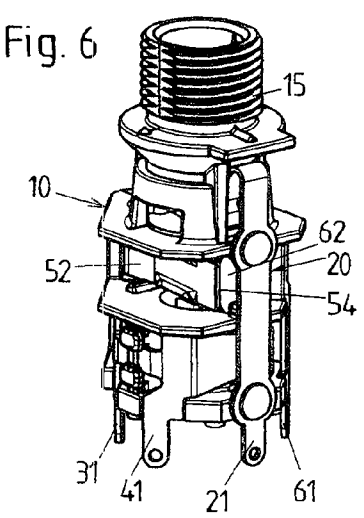
Fig. 6
Fig. 9
Fig. 10
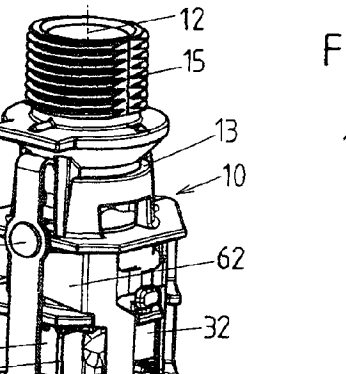
Fig. 11
Fig. 12

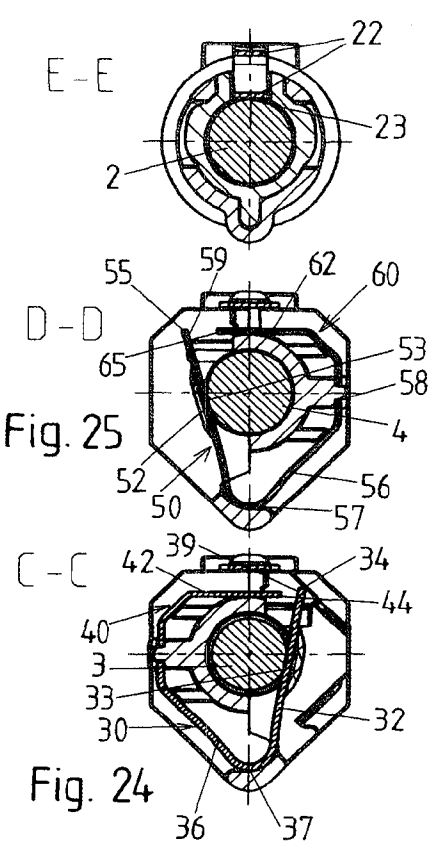
Fig. 26
Fig. 25
Fig. 24
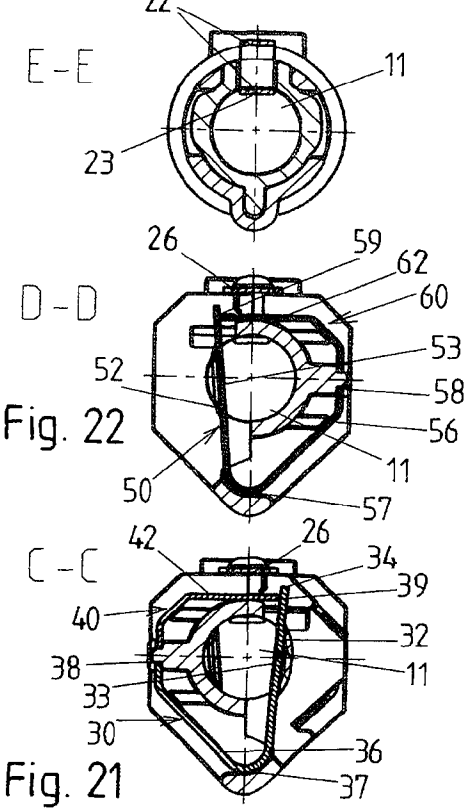
Fig. 23
Fig. 22
Fig. 21
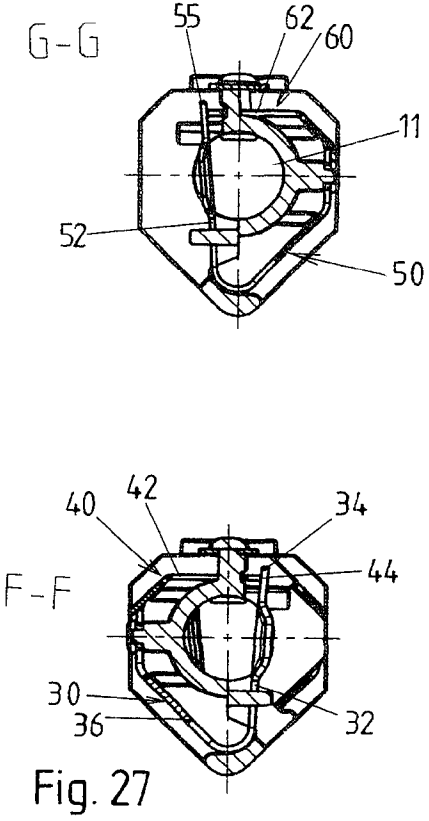
Fig. 28
Fig. 27

JACK SOCKET FOR PRODUCING AN ELECTRICAL PLUG CONNECTION

The invention relates to a jack socket to produce an electrical plug connection with a jack plug, which has a plug shaft with a contact tip, a contact sleeve and a contact ring situated between the contact sleeve and the contact tip, if necessary, comprising a plug housing with a receiving space, in which the plug shaft of the jack plug can be inserted from an insertion end of the plug housing in the direction of a longitudinal center axis of the receiving space, and contacts supported by the plug housing, which comprises a sleeve contact with a contact section for contacting the contact sleeve of the jack plug and with a connecting section to produce an electrical connection with the sleeve contact; a tip contact with a contact section, which connects to a free end of the tip contact and which, when the jack plug is inserted, can be displaced from the contact tip from an initial position into a final position and, in the plug-in state of the jack plug, can be contacted from the contact tip to a tip contact point, and with a connecting section to produce an electrical connection with the tip contact; and a tip switching contact with a contact section which, in the initial position of the contact section of the tip contact, lies against a tip switching contact of the contact section of the tip contact and is lifted from the contact section of the tip contact into the final position of the contact section of the tip contact; and with a connecting section to produce an electrical connection with the tip switching contact, with the connecting sections of the contacts protruding from the insertion end of the opposing connecting end of the plug housing and having a longitudinal extension lying parallel to the longitudinal center axis of the receiving space of the plug housing.

Jack plugs are internationally widespread electrical plug connectors that, for example are used for audio applications. The design of such a jack plug is standardized by the EIA RS-453 or IEC 60603-11 standards. The English designation of such a jack plug is "TRS connector", also referred to colloquially as an "audio plug".

These jack plugs have a plug shaft (=male plug part) with a contact tip arranged on the free end, which has a constriction. A further electrical contact is formed from a sleeve-shaped section of the plug shaft (=contact sleeve), which can also be designated as a sleeve. A contact ring can be situated between the contact tip and the contact sleeve, forming another electrical contact, which, for example, forms a stereo plug. The contacts are separated by insulators.

Jack sockets act as mating connectors for such jack plugs. These have a sleeve contact for contacting the contact sleeve of the jack plug, a tip contact for contacting the contact tip of the jack plug and a ring contact for contacting the contact ring of the jack plug. If a jack plug is inserted without a contact ring, then the ring contact is non-functional (this also contacts the contact sleeve then).

Jack sockets frequently have additional switching contacts. The tip switching contact contacts the tip contact, if no jack plug is inserted. If a jack plug is inserted, then a contact section of the tip contact, which connects to the free end of the tip contact, is displaced by the contact tip against its spring-elastic reset force from an initial position into a final position. The contact section of the tip contact, which contacts the tip switching contact in the uninserted state of the jack socket at a tip switching contact contact point, is lifted from the tip switching contact as a result.

Furthermore, during the insertion of the jack plug, the connection between the ring contact and a ring switching contact is interrupted. During the insertion of the jack plug a contact section of the ring contact that attaches to a free end of the ring contact is displaced from an initial position in a final position. In the uninserted state of the jack socket, the ring switching contact contacts the contact section of the ring contact at a ring switching contact contact point of the contact section of the ring contact. When pivoting into the final position, the ring switching contact is lifted from this contact point.

In a widespread jack socket design, connecting sections of the contacts of the jack socket are formed as soldered connections. The jack socket can thus be mounted directed on a circuit board. A horizontal design (also called a "horizontal jack socket") and a vertical design (also called a "vertical jack socket") are used. In the horizontal design, the longitudinal center axis of the receiving space for the plug shaft of the jack plug is parallel to the circuit board; in the vertical design perpendicular to the circuit board.

A usual embodiment for the horizontal design is when the connecting sections of the sleeve, ring and tip contacts are arranged in a sequence on one side of the housing, with these connecting sections having a receiving space of the plug housing running in a longitudinal direction at a right angle to the longitudinal center axis. On the opposite side of the housing, connecting sections of switching contacts for the sleeve, ring and tip contacts are arranged in a sequence, with these connecting sections also running at a right angle to the longitudinal center axis of the receiving space of the plug housing. The connecting sections of all contacts are parallel to one another and stand out from the plug housing above a flattened side provided for mounting on the circuit board, and indeed in a direction that is perpendicular to the longitudinal center axis of the receiving space of the plug housing (perpendicular to the plane of the circuit board).

In the vertical embodiment, the connecting sections of the contacts project from a connecting end of the plug housing opposite the insertion end, extending parallel to the longitudinal center axis of the receiving space of the plug housing. In this design there is usually no sleeve switching contact provided so these jack sockets have five contacts and thus five connecting sections. The contact sections of the tip and ring contacts, seen in a view of the respective contact that is perpendicular to the longitudinal center axis of the receiving space of the plug housing, runs in the longitudinal direction of the longitudinal center axis. For the tip contact, its tip contact point, with which it contacts the contact tip of the plug shaft, is closer at the free end, to which the contact section of the tip contact attaches, than its tip switching contact contact point, with which it contacts the tip switching contact in the non-inserted state.

On the other hand, with the ring contact, the ring contact point, with which the ring contact contacts the contact ring of the jack plug, is further away from the free end of the ring contact, to which the contact section of the ring contact attaches, than the ring switching contact contact point, with which the ring contact contacts the ring switching contact when the jack socket is in the uninserted state. As a result, the pivoting of the contact section of the ring contact during the insertion of the jack plug is translated to the contact point between the ring contact and the ring switching contact so that, in the inserted state, a sufficiently great distance between these contacts is achieved.

The standardization of the design of jack plugs allows variances in the detailed design, particularly in the area of the contact tip, and in practice, among the manufacturers, there are differences in the exact form of the contact tip and its constriction. As a result, in practice, when the jack plug is inserted in the jack socket, there are pivotings of varying intensities, particularly of the contact section of the tip contact. As a result, there can be an insufficient distancing of the contact section of the tip contact from the tip switching contact, especially when a cable pulls obliquely on the jack plug. The consequence can be malfunctions.

Furthermore, it is important to bear in mind that, for vertical jack sockets, the conventional arrangement of the connecting sections has gained acceptance as the standard and is used by different manufacturers in the same way. Retention of this arrangement of the connecting sections is thus important.

In addition, there are known horizontal and vertical designs of jack sockets with arrangements that differ from the arrangements described of the connecting sections of the contacts, which are not used commercially or are used less frequently. Such jack sockets are derived from U.S. Pat. No. 7,198,504 B2, U.S. Pat. No. 6,690,801 B2 and U.S. Pat. No. 7,341,491 B2.

The task of the invention is to provide an improved jack socket of the type mentioned at the beginning, increasing the reliability of the interruption of the electrical connection between the tip contact and the tip switching contact when a jack plug is inserted. According to the invention, this is achieved by a jack socket with the characteristics of claim 1.

A jack socket according to the invention has the contact section of the tip contact, at least in the area encompassing the tip contact point and the tip switching contact contact point, preferably over its entire extension, a longitudinal extension that is crosswise, at a right angle in particular, to the longitudinal center axis of the receiving space of the plug housing. The tip contact point and the tip switching contact contact point of the contact section of the tip contact are spaced in this crosswise direction, particularly at a right angle, to the longitudinal center axis. Thus the tip contact point and the tip switching contact contact point of the contact section of the tip contact are spaced in relation to the circumferential direction around the longitudinal center axis of the receiving space of the plug housing (=the circumferential direction of the plug housing or the receiving space). Here the tip contact point is further away from the free end of the tip contact, to which the contact section of the tip contact attaches, than the tip switching contact contact point.

When the jack plug is inserted in the jack socket, the contact section of the tip contact is displaced against its spring-elastic reset force from an initial position into a final position. Due to the inventive embodiment, the displacement at the tip switching contact contact point is thus greater than in the area of the tip contact point. Thus, even with slightly varying forms of the contact tips of the jack plug, a more reliable opening of the electrical contact between the tip contact and the tip switching contact can be achieved, this with the compact design of the inventive jack socket.

Advantageously, the contact section of the ring contact has, at least in the area encompassing the tip contact point and the tip switching contact contact point, preferably over its entire extension, a longitudinal extension that is crosswise, particularly at a right angle, to the longitudinal center axis of the receiving space of the plug housing. The ring contact point and the ring switching contact contact point of the contact section of the ring contact are spaced in this crosswise direction, particularly perpendicular, to the longitudinal center axis. Thus the ring contact point and the ring switching contact contact point of the contact section of the ring contact are spaced in relation to the circumferential direction around the longitudinal center axis of the receiving space of the plug housing (=the circumferential direction of the plug housing or the receiving space). Here the ring contact point is further away from the free end of the ring contact, to which the contact section of the ring contact attaches, than the ring switching contact contact point. Thus, in a compact embodiment of the jack socket, a reliable opening of the electrical contact between the ring contact and the ring switching contact can be achieved when the jack plug is inserted.

To retain the conventional arrangement of the connecting sections of the contacts in the inventive jack socket, it is advantageously provided that the jack socket, seen in side views perpendicular to the longitudinal center axis of the receiving space of the plug housing, has crossing points between sections of different contacts, with the intersecting sections having different distances from the longitudinal center axis of the receiving space.

In an advantageous embodiment of the invention, it is provided that the contact section of the tip contact, seen in a cross-section through the contact section, has a convex or V-shaped part to the contact tip of the inserted jack plug, to which an enlargement of the contact section connects in the direction to the connecting end of the plug housing, via which the contact section, seen in a cross-section through the contact section and a longitudinal section through the jack socket, enclosing an angle of less than 15° with the longitudinal center axis, preferably essentially parallel to it. Due to this enlargement, the lowering of the contact section of the tip contact into the constriction of the contact tip can be limited, with the contact section with the enlargement on the contact tip in the area of its greatest circumference, which is located closer to the free end of the contact tip than the constriction, being supported. When the contact tip has different shapes, a defined position of the contact section can be achieved in this way, with its lowering into the constriction being limited. As a result, even with different shapes of the contact tips, a reliable opening of the electrical contact between the tip contact and the tip switching contact can be achieved.

An advantageous embodiment provides that the plug housing of the jack socket has a bottom, which partially closes off the receiving space to the connecting end of the plug housing and forms a stop for the contact tip, limiting the insertion of the plug shaft of the jack plug into the jack socket. In the completely inserted state the contact tip lies against the stop of the bottom of the plug housing. Preferably this stop is formed from the edge of a recess in the bottom of the plug housing, into which the contact tip projects with its front end. Due to this embodiment, a defined position of the contact section of the tip contact is supported, when jack plugs from different manufacturers in the jack socket are inserted so the reliability of the opening of the electrical connection between the tip contact and tip switching contact is further improved.

The jack plug provided to produce the plug connection with the jack socket is preferably embodied according to the EIA RS-453 or IEC 60603-11 standard. Such a jack plug, which can be used particularly for audio applications, is also called an audio plug.

Specifically, it concerns a 6.35 mm jack plug.

With the "longitudinal extension" of a contact or a section of a contact, the direction of the greatest extension of the contact or a section of a contact is described in the usual manner.

Figure 13:
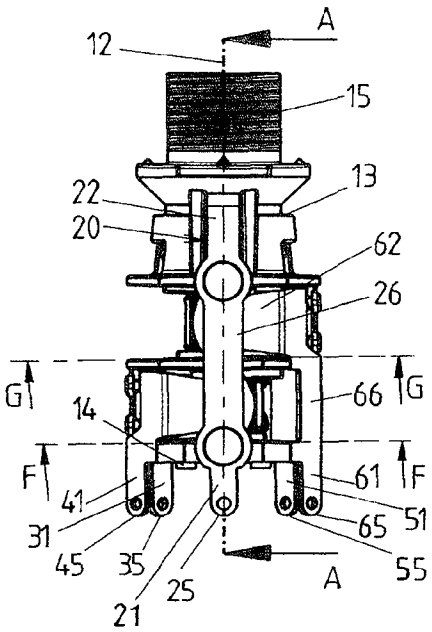
Figure 14:
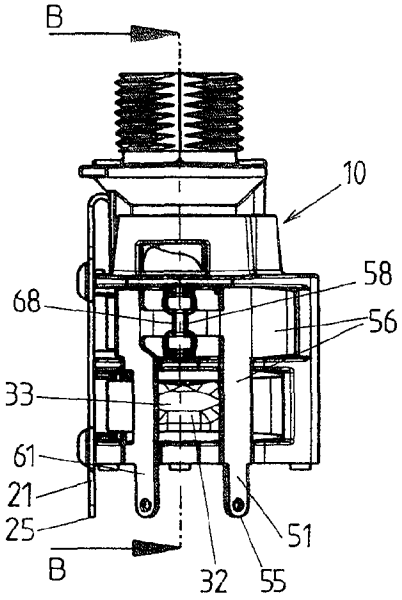
Figure 15:
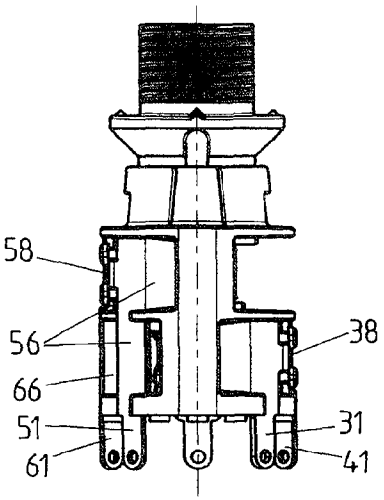
Figure 17:
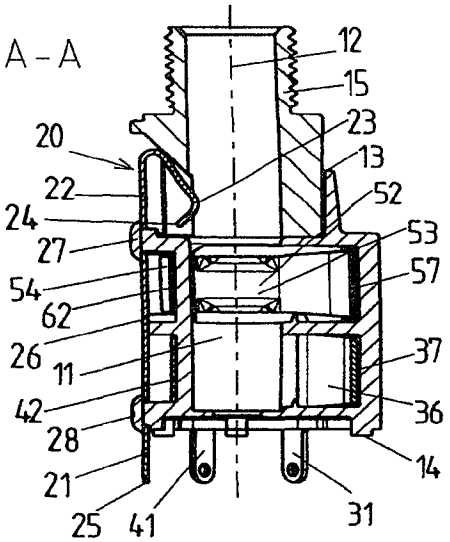
Figure 18:
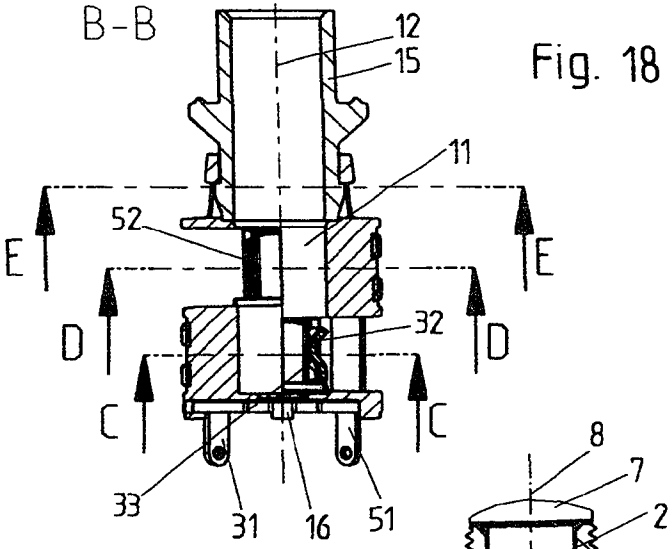
Figure 19:
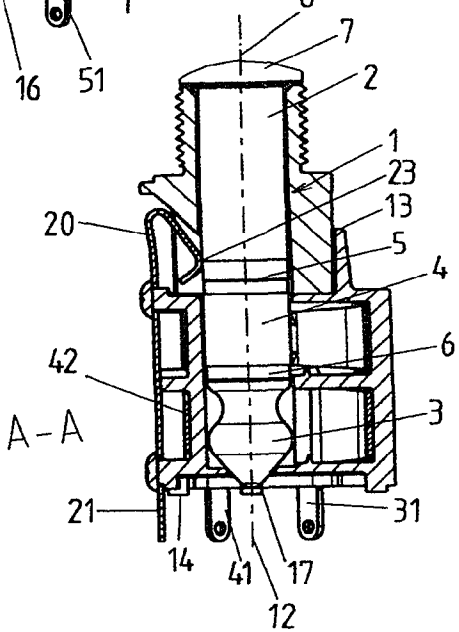
Figure 20:
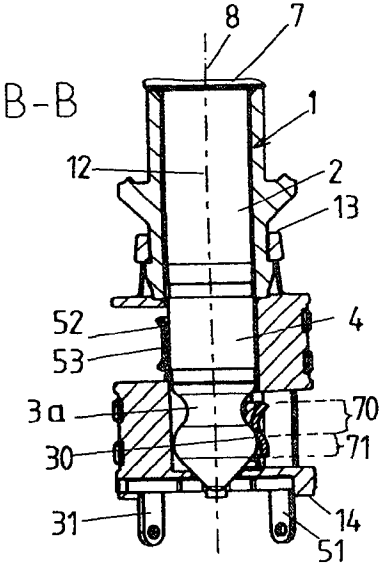

Further advantages and details are explained in the following using the enclosed drawing. Shown are:

FIGS. 1 to 4, three-dimensional representations of an inventive jack socket in four positions of the jack socket, each rotated 90° around the longitudinal center axis;

FIGS. 5 & 6, three-dimensional representations from two further angles;

FIG. 7 an overhead view of the insertion end;

FIG. 8 an overhead view of the connecting end;

FIGS. 9-12 Representations according to FIGS. 1 to 4, with only the contacts represented and the remaining parts of the jack socket omitted to allow a clearer representation of the contacts;

FIGS. 13-16 Side views of the jack socket in the rotated positions according to FIGS. 1 to 4;

FIG. 17 a section along Line AA from FIG. 13;

FIG. 18 a section along Line BB from FIG. 14;

FIG. 19 a section according to FIG. 17 with an inserted jack plug (the jack plug only partially represented);

FIG. 20 a section according to FIG. 18 with an inserted jack plug (the jack plug only partially represented);

FIGS. 21-23 Sections along Lines CC, DD and EE from FIG. 18;

FIGS. 24-26 Sections according to FIGS. 21-23 but with an inserted jack plug;

FIGS. 27 & 28 Sections along Lines FF and GG from FIG. 13.

An embodiment example of a jack socket (="audio jack") according to the invention in the form of a 6.35 mm jack plug socket, which can be used particularly for audio applications, is represented in the enclosed Figures.

The jack socket is used to produce an electrical plug connection with a jack plug, part of which is represented in FIGS. 19 and 20. The jack plug is comprised of a plug shaft (=male connector part). The plug shaft 1 is comprised of a contact sleeve 2 (also referred to as a sleeve) and a contact tip 3 (also referred to as a contact tip); between the contact sleeve and the contact tip 3 is a contact ring 4 (also referred to as a ring). The contact sleeve 2, the contact tip 3 and the contact ring 4 are insulated from one another by insulators 5, 6. The contact ring 4 (and with it one of the insulators 5, 6) could also be omitted. The plug shaft 1 projects from a plug housing 7, with only a small portion of it visible in FIGS. 19 and 20.

The jack plug is designed according to the EIA RS-453 or IEC 60603-11 standard, with the embodiment example involving only a 6.35 mm jack plug.

The jack plug is with its plug shaft 1 can be inserted into a female receptacle of the jack socket in an insertion direction. With regard to its contacts for the contact tip, the contact sleeve and the contact ring described below, such a jack socket is also referred to as a stereo jack socket.

The jack socket is comprised of a plug housing 10 made of an insulating material. On the plug housing 10, contacts 20, 30, 40, 50, 60 of the jack socket are defined. The plug housing 10 has a receiving space 11, in which the plug shaft 1 (at least over a portion of its longitudinal extension) can be inserted to produce the plug connection between the jack plug and the jack socket. The receiving space 11 has a longitudinal center axis 12. An insertion end 13 of the plug shaft 1 is inserted into the receiving space of the plug housing 10 in the direction of this longitudinal center axis 12. Here the longitudinal center axis 8 of the plug shaft 1 coincides with the longitudinal center axis 12 of the receiving space 11 (i.e., they are situated parallel to one another and are located at the same place).

The insertion of the plug shaft 1 is guided by a socket 15. This holds the inserted plug shaft 1 also in a coaxial orientation with the plug housing 10. The socket 15 is fixed to the plug housing 10. A nut can be screwed onto an external thread of the socket 10. This way a mechanical fastening of the jack socket is possible, for example, in a receiving slot of a housing plate.

The socket 15 can be made of metal and connected electrically to the sleeve contact described below. In this sense, it can be regarded as part of the sleeve contact. An embodiment made of plastic is also possible, with the socket being regarded as part of the plug housing 10. Also a one-piece embodiment of the socket with the plug housing can be provided in a modified embodiment.

The interior of the socket 15 together with the receiving space 11 of the plug housing 10 form the female receptacle for the plug shaft 1.

Contacts 20, 30, 40, 50, 60 each have a connecting section 21, 31, 41, 51, 61, which projects from the attachment end 14 of the plug housing 10 opposite the insertion end 13 (the ends 13, 14 form opposing ends of the plug housing 10 in relation to the longitudinal center axis 12), with the connecting sections 21, 31, 41, 51, 61 each having a longitudinal extension that is parallel to the longitudinal center axis 12. Electrical connections can be produced with the contacts 20, 30, 40, 50, 60 via these connecting sections 21, 31, 41, 51, 61. For example, the connecting sections 21, 31, 41, 51, 61 for this can be inserted into the solder eyes of a circuit board and soldered or connecting cables can be soldered on.

The sleeve contact 20 is used for contacting the contact sleeve 2 in the inserted state of the plug shaft 1. The sleeve contact has a spring-shaped contact section 22, in the manner of a contact tongue. When the jack plug is inserted, the contact section 22 is displaced and, in the inserted state of the jack plug, the sleeve contact with a sleeve contact point 23 of the contact section 22 lies against the contact sleeve 2 of the plug shaft 1. The contact section 22 attaches to one of the free ends 24 of the sleeve contact. The connecting section 21 attaches to the other free end of the sleeve contact. The contact section 22 is connected to the connecting section 21 via a link 26. The link 26 is fastened to mounting positions 27, 28 on the plug housing 10, for example, by melting protrusions of the plug housing 10 emerging from openings in the sleeve contact. The contact section 22 runs from the mounting position 27 to the free end 24, with a partial section approaching the longitudinal center axis 12 and a partial section moving away from the longitudinal center axis 12 to the free end 24, formed through bendings, and with the latter partial section forming the free end 24.

In a side view of the plug housing, with the viewing direction perpendicular to the longitudinal center axis 12 and with, in this viewing direction, the sleeve contact point 23 and the longitudinal center axis 12 overlapping, the longitudinal extension of the contact section 22 of the sleeve contact 20 is parallel to the longitudinal center axis 12. Such side views correspond to the representations of FIGS. 13 and 15. In other words, it involves a side view perpendicular to the longitudinal center axis 12 and parallel to the surface normals on the contact sleeve 2 at the location of the contacting by the sleeve contact point 23. In the embodiment example, the longitudinal extension of the sleeve contact 20, on the whole, is parallel to the longitudinal center axis 12. In modified embodiment examples, for example, longitudinal extensions of the contact section 22 and/or of the link 26 or partial sections of it perpendicular to the longitudinal center axis 12 are also possible.

In case of an embodiment of the socket 15 made of metal and a connection with the sleeve contact 20, the socket 15 could serve as the contact section or part of the contact section of the sleeve contact 20. A contacting of the contact sleeve 2 in this case could also occur only via the socket 15. However, a spring-elastic formed contact section 22 (in the manner of a contact tongue) of the sleeve contact 20 is preferred.

The tip contact 30 is used for contacting the contact tip 3 of an inserted jack plug. Here the tip contact 30 has a contact section 32, which lies against a tip contact point 33 of the contact section 32 on the contact tip 3 of the inserted jack plug. The spring-elastic contact section 32, which connects to the free end 34 of the tip contact 30, is formed here in the manner of a contact tongue. Without the inserted jack plug the contact section 32 assumes an initial position, see FIGS. 18 and 21. During the insertion of the jack plug the contact section 32 of the contact tip 3 is displaced against its spring-elastic reset force (pivoted and/or bent) and assumes a final position in the inserted state, see FIGS. 20 and 24.

In this final position, the contact section 32 is engaged in the constriction 3*a* of the contact tip 3 and, with its spring-elastic holding force, secures the jack plug against being pulled out of the jack socket.

The connecting section 31 attaches to the other free end 35 of the tip contact 30. The contact section 32 is connected to the connecting section 31 by a link 36. At the transition between the link 36 and the contact section 32 the tip contact 30 is supported against a support point 37 on the plug housing 10. The contact section 32 attaching to the free end 34 forms the resilient contact tongue. The fastening to the plug housing 10 takes place in addition through a extension of the link, which is fastened to a mounting position 38 on the plug housing 10, for example, by melting protrusions of the plug housing 10.

Figure 16:
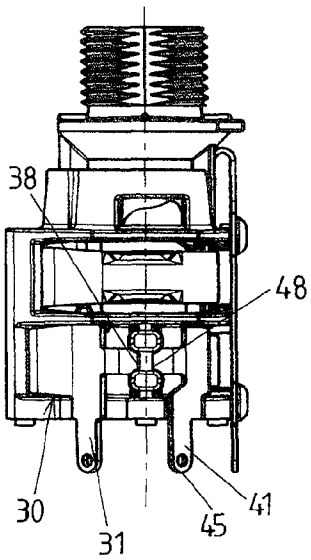

Seen in a side view perpendicular to the longitudinal center axis 12, in which the tip contact point 33 and the longitudinal center axis 12 overlap, the contact section 32 of the tip contact 30 has a horizontal longitudinal extension perpendicular to the longitudinal center axis. So it involves a side view perpendicular to the longitudinal center axis 12 and parallel to a projection of the surface normals, which the contact tip 3 has at the contacting point due to the tip contact point 23, on a vertical plane perpendicular to the longitudinal center axis 12. FIG. 14 and FIG. 16 correspond to such a side view.

The link 36 includes a partial section attaching to the contact section 32, which has a longitudinal extension running perpendicular to the longitudinal center axis 12 and a partial section attaching via an angular offset, which connects the previously mentioned partial section with the connecting section 31 due to its course parallel to the longitudinal center axis 12.

The free end 35 of the connecting section 31 of the tip contact 30 and the tip contact point of the contact section 32 of the tip contact 30, in relation to the circumferential direction around the longitudinal center axis 12 (=the circumferential direction of the plug housing 10 or of the receiving space 11), are spaced by more than 90°.

The ring contact 50 is used for contacting the contact ring 4. To this end, it has a contact section 52, which, in the inserted state of the jack plug, lies against a ring contact point 53 of the ring contact 50 on the contact ring 4. The spring-elastic contact section 52, which attaches to the free end 54 of the ring contact 50, is formed in the manner of a contact tongue. Without the inserted jack plug, the contact section 52 assumes an initial position, see FIGS. 18 and 22. During the insertion of the jack plug, the contact section 52 is displaced from the plug shaft 1 against its spring-elastic reset force into a final position (pivoted and/or bent), see FIGS. 20 and 25.

The connecting section 51 of the ring contact 50 attaches to the other free end 55. The contact section 52 is connected to the connecting section 51 via a link 56. At the transition between the contact section 52 and the link 56 the ring contact 50 is supported on a support point 57 on the plug housing 10. The contact section 52 attaching to the free end 54 forms the resilient contact tongue. To fasten the ring contact 50 to the plug housing 10, furthermore, an extension of the link 56 is connected on a mounting position 58 to the plug housing 10, for example, by melting a protrusion of the plug housing 10.

In a side view perpendicular to the longitudinal center axis 12, in which the ring contact point 53 and the longitudinal center axis 12 overlap, the contact section 52 of the ring contact 50 has a longitudinal extension, which is perpendicular to the longitudinal center axis 12. Thus it concerns a side view perpendicular to the longitudinal center axis 12 and parallel to the surface normals on the contact ring 4 at the point of the contacting through the ring contact point 53. FIG. 14 and FIG. 16 show such a side view.

The link 56 has a partial section attaching to the connecting section 51, whose longitudinal extension is parallel to the longitudinal center axis 12 and a partial section attaching to it via an angular offset, whose longitudinal extension is perpendicular to the longitudinal center axis 12 and to which the contact section 52 attaches.

The free end 55 of the connecting section 51 of the ring contact 50 and the ring contact point 53 of the contact section 52 of the ring contact 50, in relation to the circumferential direction around the longitudinal center axis 12 (=circumferential direction of the plug housing 10 or of its receiving space 11), are spaced by more than 90°.

The tip contact point 33 of the contact section 32 of the tip contact 30 and the ring contact point 53 of the contact section 52 of the ring contact 50, in relation to the circumferential direction around the longitudinal center axis 12, are spaced from one another by more than 120°, preferably by more than 180°, as particularly the comparison of FIGS. 24 and 25 shows.

The tip switching contact 40 has a contact section 42 that attaches to the free end 44 of the tip switching contact 40. The contact section 42 has a longitudinal extension perpendicular to the longitudinal center axis 12 and, in the initial position of the contact section 32 of the tip contact 30, contacts the contact section 32 of the tip contact 30 at a tip switching contact contact point 39 of the contact section 32 of the tip contact 30. The contact section 32 of the tip contact 30 with its tip switching contact contact point 39, for example, as shown, is located at the free end 44 of the tip switching contact 40. The attachment could also be on a bending of the contact section 42 of the tip switching contact 40, via which the contact section 42 of the tip switching contact 40 extends to the free end 44.

The tip switching contact contact point is preferably less than 2 mm, particularly preferred, less than 1 mm away from the free end 34 of the tip contact 30.

Preferably the contact segment 32 of the tip contact 30 and the contact segment 42 of the tip switching contact 40 or at least segments of it are at an angle to one another, in the range from 90°+/−20°, when there is an electrical contact between these two contact sections 32, 42.

The connecting section 41 attaches to the other free end 45 of the tip switching contact 40. The connecting section 41 and the contact section 42 are directly connected with one another via an angular offset or connected with one another via a link 46. To fasten to the plug housing 10, as shown, an extension of the link 46 can be provided, which is fastened to a mounting position 48 on the plug housing 10, for example, by melting protrusions of the plug housing 10.

The tip contact point 33 and the tip switching contact contact point 39 are spaced in the direction of the longitudinal extension of the contact section 32 of the tip contact 30 in a direction perpendicular to the longitudinal center axis 12, with the tip switching contact contact point 39 lying closer at the free end 34 of the tip contact 30 than the tip contact point 33.

When a jack plug is inserted, then the contact section 32 is bent and/or pivoted by it from the initial position into the final position, with the tip switching contact contact point 39 lifting from the contact section 42. Because of the translation brought about in the manner of a lever, the movement amplitude of the tip contact 30 at the point of the tip switching contact contact point 39 is greater than that at the tip contact point 33.

The ring switching contact 60 has a contact section 62 connecting to the free end 64. The contact section 62 has a longitudinal extension that is perpendicular to the longitudinal center axis 12 and, in the initial position of the contact section 52 of the ring contact 50, contacts the contact section 52 of the ring contact 50 at a ring switching contact contact point 59 of the contact section 52 of the ring contact 50. As shown, the contact section 52 of the ring contact 50 with its ring switching contact contact point 59, for example, lies against the free end 64 of the ring switching contact 60. The attachment could also be on a bending of the contact section 62 of the ring switching contact 60, via which the contact section 62 of the ring switching contact 60 extends to the free end 64.

The ring switching contact contact point 59 is preferably less than 2 mm, particularly preferred, less than 1 mm away from the free end 54 of the ring contact 50.

Preferably the contact section 52 of the ring contact 50 and the contact section 62 of the ring switching contact 60, or at least sections of them, are at an angle to one another, in the range from 90°+/−20°, when there is an electrical contact between these two contact sections 52, 62.

The connecting section 61 attaches to the other free end 65 of the ring switching contact 60. The connecting section 61 and the contact section 62 are connected with one another via a link 66, whose longitudinal extension, at least in part in the embodiment example shown, is essentially parallel to the longitudinal center axis 12 over its entire length, with the link 66 attaching in a straight line to the connecting section 61. As shown, an extension of the contact section 62 can be provided to fasten to the plug housing 10, which is fastened to a mounting position 68 on the plug housing 10, for example, by melting protrusions of the plug housing 10.

The ring contact point 53 and the ring switching contact contact point 59 are spaced in the direction of the longitudinal extension of the contact section 52 of the ring contact 50 in a direction perpendicular to the longitudinal center axis 12, with the ring switching contact contact point 59 being closer at the free end 54 of the ring contact 50 than the ring contact point 53.

When a jack plug is inserted, then the contact section 52 is bent and/or pivoted by it from the initial position into the final position, with the tip switching contact contact point 59 lifting from the contact section 62. Because of the translation brought about in the manner of a lever, the movement amplitude of the ring contact 50 at the point of the ring switching contact contact point 59 is greater than that at the ring contact point 53.

Seen in a view of the jack socket at the attachment end of the plug housing (i.e., in a view in the insertion direction in which the jack plug is inserted), which is shown in FIG. 8, the free ends 25, 35, 45, 55, 65 of the connecting sections 21, 31, 41, 51, 61 of the contacts 20, 30, 40, 50, 60 are in an imaginary circle in the arrangement represented in FIG. 8. The tip contact 30, ring contact 50, tip switching contact 40 and ring switching contact 60 with their free ends are on the sides of an imaginary square, with the sleeve contact 20 with its free end parallel to one of the diagonals of the square and inside the square in a corner area of the square. In the clockwise direction, following the sleeve contact 20, comes first the ring switching contact 60, then the ring contact 50, then the tip contact 30 and then the tip switching contact 40 in succession.

In side views perpendicular to the longitudinal center axis 12 and seen in a view of the sections of the contacts, crossing points between sections of different contacts exist, to which the crossing sections have different distances from the longitudinal center axis 12. So, with their longitudinal extension parallel to the longitudinal center axis 12, partial sections of the links 56, 66 of the ring contact 50 and of the ring switching contacts 60 intersect the contact section 32 of the tip contact 30 (seen in a side view perpendicular to the longitudinal center axis 12, in which the tip contact point 33 and the longitudinal center axis 12 overlap), see FIG. 14. The links 56, 66 have greater distances from the longitudinal center axis 12 than the contact section 32.

The link 26 of the sleeve contact 20, with its longitudinal extension running parallel to the longitudinal center axis 12, intersects the contact sections 42, 62 of the tip switching contact 40 and ring switching contact 60 (seen in a view perpendicular to the longitudinal center axis 12, in which the link 26 and the longitudinal center axis 12 overlap), see FIG. 13. The link 26 has a greater distance from the longitudinal center axis 12 than the contact sections 42, 62.

The tip contact point 33 of the tip contact 30 and the ring contact point 53 of the ring contact 50 contact the contact tip 3 and the contact ring 4 at points that, in relation to the circumferential direction of the plug shaft 1, essentially lie opposite one another, as the comparison of FIGS. 24 and 25 shows. The sleeve contact point 23 of the contact section 22 of the sleeve contact 20 contacts the contact sleeve 2 at a point that, in relation to the circumferential direction of the plug shaft 1, is between the two points mentioned, preferably spaced 90° from each of the two contact points mentioned.

Seen in the cross-section through the tip contact, with this cross-section at the point of the longitudinal extension of the contact section 32 through the tip contact 30, where the tip contact point 33 lies, and running through the longitudinal center axis 12, the contact section 32 of the tip contact 30 has a part 70 that is designed as a convex curve to the contact tip 3, see FIG. 20. Also a V-shaped formed design of the part 70 to the contact tip 3 is possible. An enlargement 71 of the contact section 32 attaches to the part 70 in the direction toward the attachment end 14 of the plug housing, via which the contact section 32, seen in this cross-section, is essentially oriented parallel to the longitudinal center axis 12 (i.e., creating an angle of less than 15° to it). With the part 70, the contact section 32 engages the contact tip 3 in the constriction 3*a*. With the enlargement 71 the contact section 32 can support itself on the contact tip 3 in the area of the greatest circumference of the contact tip 3, which lies between the constriction 3*a* and the free end of the plug shaft 1. The clicking of the contact section 32 into place in the constriction 3*a* and thus the approach of the tip switching contact contact point 39 to the contact section 42 of the tip switching contact 40) is limited as a result. Also, with more pronounced formations of the constriction 3*a*, sufficient distance is thus maintained between the contact section 42 of the tip switching contact 40 and the contact section 32 of the tip contact 30.

The bottom 10*a* of the plug housing has a recess 16, in which the contact tip 3 of the inserted jack plug engages, attaching to its free end and forming a stop 17 on its edge, which limits the insertion of the plug shaft 1. A well defined position of the contact tip 3 with its constriction 3*a* relative to the contact section 32 of the tip contact 30 in relation to the direction of the longitudinal center axis 12 is achieved as a result.

In the inventive jack socket, jack plugs without a contact ring 4 can also be inserted. The ring contact 50 and the ring switching contact 60 can then remain unoccupied. However, since the ring contact 50, in the inserted state of the jack plug, contacts the contact sleeve 2 and is displaced into its final position, the ring contact 50 can also be used as an (additional) sleeve contact 20. The ring switching contact 60 could then be used as a switched sleeve contact.

| Legend for the reference numbers: | |
|---|---|
| 1 | Plug shaft |
| 2 | Contact sleeve |
| 3 | Contact tip |
| 3a | Constriction |
| 4 | Contact ring |
| 5 | Insulator |
| 6 | Insulator |
| 7 | Plug housing |
| 8 | Longitudinal center axis |
| 10 | Plug housing |
| 10a | Bottom |
| 11 | Receiving space |
| 12 | Longitudinal center axis |
| 13 | Insertion end |
| 14 | Attachment end |
| 15 | Socket |
| 16 | Recess |
| 17 | Stop |
| 20 | Sleeve contact |
| 21 | Connecting section |
| 22 | Contact section |
| 23 | Sleeve contact point |
| 24 | Free end |
| 25 | Free end |
| 26 | Link |
| 27 | Mounting position |
| 28 | Mounting position |
| 30 | Tip contact |
| 31 | Connecting section |
| 32 | Contact section |
| 33 | Tip contact point |
| 34 | Free end |
| 35 | Free end |
| 36 | Link |
| 37 | Support point |
| 38 | Mounting position |
| 39 | Tip switching contact contact point |
| 40 | Tip switching contact |
| 41 | Connecting section |
| 42 | Contact section |
| 44 | Free end |
| 45 | Free end |
| 46 | Link |
| 48 | Mounting position |
| 50 | Ring contact |
| 51 | Connecting section |
| 52 | Contact section |
| 53 | Ring contact point |
| 54 | Free end |
| 55 | Free end |
| 56 | Link |
| 57 | Support point |
| 58 | Mounting position |
| 59 | Ring switching contact contact point |
| 60 | Ring switching contact |
| 61 | Connecting section |
| 62 | Contact section |
| 64 | Free end |
| 65 | Free end |
| 66 | Connecting section |
| 68 | Mounting position |
| 70 | Part |
| 71 | Enlargement |

The invention claimed is:

1. A jack socket to produce an electrical plug connection with a jack plug, which has a plug shaft (1) with a contact tip (3), and a contact sleeve (2), comprising a plug housing (10) with a receiving space (11), in which the plug shaft (1) of the jack plug can be inserted from an insertion end (13) of the plug housing (10) in the direction of a longitudinal center axis (12) of the receiving space (11); and contacts supported by the plug housing (10); said contact comprising a sleeve contact (20) with a contact section (22) to contact the contact sleeve (2) of the jack plug and with a connecting section (21) to produce a electrical connection with the sleeve contact (20), a tip contact (30) with a contact section (32) that attaches to a free end of the tip contact (30) and during the insertion of the jack plug can be displaced by the contact tip (3) from an initial position into a final position and, in the inserted state of the jack plug, can be contacted from the contact tip (3) to a tip contact point (33); and with a connecting section (31) to produce a electrical connection with the tip contact (30), and a tip switching contact (40) with a contact section (42), which in the initial position of the contact section (32) of the tip contact (30) lies against a tip switching contact contact point (39) of the contact section (32) of the tip contact(30) and is lifted from the contact section (32) of the tip contact (30) into the final position of the contact section (32) of the tip contact (30); and with a connecting section (41) to produce a electrical connection with the tip switching contact (40), wherein the connecting sections (21, 31, 41) of the contacts (20, 30, 40) project from an attachment end (14) of the plug housing (10) opposite the insertion end (13) and have a longitudinal extension parallel to the longitudinal center axis (12) of the receiving space (11) of the plug housing (10), wherein the contact section (32) of the tip contact(30) has at least a longitudinal extension in an area encompassing the tip contact point (33) and the tip switching contact contact point (39), which longitudinal extension lies cross-wise to the longitudinal center axis (12) of the receiving space (11) of the plug housing (10), and wherein the tip contact point (33) and the tip switching contact contact point (39) of the contact section (32) of the tip contact(30) are distanced in this direction cross-wise to the longitudinal center axis (12) of the receiving space (11) of the plug housing (10), wherein the tip contact point (33) lies further away from the free end (34) of the tip contact(30), to which the contact section (32) of the tip contact(30) attaches, than the tip switching contact contact point (39).

2. A jack socket according to claim 1, wherein the jack socket, seen in side views perpendicular to the longitudinal center axis (12) of the receiving space (11) of the plug housing (10), has crossing points between sections of different contacts, with the intersecting sections having different distances from the longitudinal center axis (12) of the receiving space (11) of the plug housing (10).

3. A jack socket according to claim 1, wherein the tip contact (30) includes a link (36) that connects the contact section (32) of the tip contact (30) with the connecting section (31) of the tip contact (30) and from which at least a partial section has a longitudinal extension running perpendicular to the longitudinal center axis (12) of the receiving space (11).

4. A jack socket according to claim 1, wherein the free end (35) of the connecting section (31) of the tip contact (30) and the tip contact point (33) of the contact section (32) of the tip contact (30), in relation to the circumferential direction around the longitudinal center axis (12) of the receiving space (11), are spaced by more than 90°.

5. A jack socket according to claim 1, wherein the tip contact point (33) of the contact section (32) of the tip contact (30) and the ring contact point (53) of the contact section (52) of the ring contact (50), in relation to the circumferential direction around the longitudinal center axis (12) of the receiving space, (11) are offset from one another by at least 120°.

6. A jack socket according to claim 1, wherein the contact section (32) of the tip contact (30) in a cross-section running through the contact section (32) of the tip contact (30), said cross-section through the tip contact point (33) and the longitudinal center axis (12) of the receiving space (11), said cross-section has a part with a convex or V-shape (30) towards the contact tip (3), which part is followed by an enlargement (31) in the direction toward the attachment end (14) of the plug housing (10); over the extension of said enlargement the contact section (32) encloses an angle of less than 15° with the longitudinal center axis (12) of the receiving space (11), in a cross section through the contact section (32) of the tip contact (30), said cross section running through the tip contact point (33) of the contact section (32) and the longitudinal center axis (12) of the receiving space (11).

7. A jack socket according to claim 1, wherein the sleeve contact (20) includes a link (26), which connects the contact section (22) of the sleeve contact (20) with the connecting section (21) of the sleeve contact (20) and from which at least a partial section has a longitudinal extension running parallel to the longitudinal center axis (12) of the receiving space (11).

8. A jack socket according to claim 7, wherein the link (26) of the sleeve contact (20) has crossing points with the contact section (62) of the ring switching contact (60) and the contact section (42) of the tip switching contact (40), and the link (26) of the sleeve contact (20) at these crossing points has a greater distance from the longitudinal center axis (12) of the receiving space (11) than the contact section (62) of the ring switching contact (60) and the contact section (42) of the tip switching contact (40).

9. A jack socket according to claim 1, wherein the plug housing (10) has a bottom (10*a*), which closes the receiving space (11), at least partially, to the attachment end (14) of the plug housing (10) and which forms a stop (17) for the contact tip (3) to limit the insertion of the plug shaft (1) of the jack plug.

10. A jack socket according to claim 9, wherein the bottom (10*a*) of the plug housing (10) has a recess (16) in which, in the inserted state of the jack plug, an end section of the contact tip (3) projects and whose edge forms the stop (17) for the contact tip (3).

11. A jack socket according to claim 1, wherein the contacts supported by the plug housing (10) further comprise a ring contact (50) with a contact section (52) that attaches to a free end (54) of the ring contact section and, during the insertion of the jack plug, can be displaced by a contact ring (4) of the jack plug, which is arranged between the contact sleeve (2) and the contact tip (3), from an initial position into a final position, and, in the inserted state of the jack plug, can be contacted from the contact ring (4) to a ring contact point (53); and with a connecting section (51) to produce a electrical connection with the ring contact (50), and a ring switching contact (60) with a contact section (62), which in the initial position of the contact section (52) of the ring contact (50) lies against a ring switching contact contact point (59) of the contact section (52) of the ring contact (50) and from which the contact section (52) of the ring contact (50) is lifted from into the final position of the contact section (52) of the ring contact (50); and with a connecting section (61) to produce an electrical connection with the ring switching contact (60).

12. A jack socket according to claim 11, wherein the contact section (52) of the ring contact (50) has at least a longitudinal extension in an area encompassing the ring contact point (53) and the ring switching contact contact point (59), which lies cross-wise to the longitudinal center axis (12) of the receiving space (11) of the plug housing (10); the ring contact point (53) and the ring switching contact contact point (59) being spaced in this direction cross-wise to the longitudinal center axis (12) of the receiving space (11) of the plug housing (10), wherein the ring contact point (53) lies further away from the free end (54) of the ring contact (50), to which the contact section (52) of the ring contact (50) attaches, than the ring switching contact contact point (59).

13. A jack socket according to claim 11 wherein free ends (25, 35, 45, 55, 65) of the connecting sections (21, 31, 41, 51, 61) of the contacts (20, 30, 40, 50, 60) lie in an imaginary circle, wherein, in the circumferential direction of the circle in the clockwise direction, the sleeve contact (20) is followed at first by, the ring switching contact (60), followed then by the ring contact (50), then by the tip contact (30) and then by the tip switching contact (40).

14. A jack socket claim 11, wherein the free end (55) of the connecting section (51) of the ring contact (50) and the ring contact point (53) of the contact section (52) of the ring contact (50), in relation to the circumferential direction around the longitudinal center axis (12) of the receiving space (11), are spaced by more than 90°.

15. A jack socket according to claim 11, wherein the ring contact (50) and the ring switching contact (60) each includes a link (56, 66), which connects the contact section (52, 62) of the respective contact (50, 60) with the connecting section (51, 61) of the respective contact (50, 60) and from which at least a partial section has a longitudinal extension that is parallel to the longitudinal center axis (12) of the receiving space (11) of the plug housing (10).

16. A jack socket according to claim 15, wherein the links (56, 66) of the ring contact (50) and of the ring switching contact (60), have crossing points with the contact section (32) of the tip contact, and the links (56, 66) of the ring contact (50) and of the ring switching contact (60) at the crossing points have greater distances from the longitudinal center axis (12) of the receiving space (11) than the contact section (32) of the tip contact (30).

17. A jack socket according to claim 15, wherein, in addition to the first partial section of the link (56) of the ring contact (50), which has a longitudinal extension parallel to the longitudinal center axis (12) of the receiving space (11), there is a second partial section, which has a longitudinal extension perpendicular to the longitudinal center axis (12) of the receiving space (11), with the second partial section of the link (56) attaching to the contact section (52) of the ring contact (50) and the first partial section of the link (56) connecting the second partial section of the link (56) with the connecting section (51) of the ring contact (50).

* * * * *